US010745862B2

(12) United States Patent
Sanapo et al.

(10) Patent No.: US 10,745,862 B2
(45) Date of Patent: Aug. 18, 2020

(54) WATER-FREE SURFACE SIZING COMPOSITION AND METHOD FOR TREATING A PAPER SUBSTRATE WITH SAME

(71) Applicant: Ecolab USA Inc., St. Paul, MN (US)

(72) Inventors: Gabriel Fernando Sanapo, Victoriaville (CA); Matieu Jacques, Kingsey Falls (CA); Tommy Giguere, Drummondville (CA)

(73) Assignee: ECOLAB USA INC., St. Paul, MN (US)

( * ) Notice: Subject to any disclaimer, the term of this patent is extended or adjusted under 35 U.S.C. 154(b) by 235 days.

(21) Appl. No.: 15/452,000

(22) Filed: Mar. 7, 2017

(65) Prior Publication Data

US 2017/0175337 A1 Jun. 22, 2017

Related U.S. Application Data

(62) Division of application No. 14/303,851, filed on Jun. 13, 2014, now abandoned.

(60) Provisional application No. 61/834,530, filed on Jun. 13, 2013.

(51) Int. Cl.

| | |
|---|---|
| ***B05D 1/00*** | (2006.01) |
| ***D21H 25/02*** | (2006.01) |
| ***D21H 17/14*** | (2006.01) |
| ***D21H 21/16*** | (2006.01) |
| ***D21H 17/17*** | (2006.01) |
| ***D21H 17/03*** | (2006.01) |
| ***D21H 25/06*** | (2006.01) |
| ***D21H 17/04*** | (2006.01) |
| ***D21H 17/07*** | (2006.01) |

(52) U.S. Cl.

CPC ..... *D21H 25/02* (2013.01); *D21H 17/03* (2013.01); *D21H 17/04* (2013.01); *D21H 17/07* (2013.01); *D21H 17/14* (2013.01); *D21H 17/17* (2013.01); *D21H 21/16* (2013.01); *D21H 25/06* (2013.01)

(58) Field of Classification Search

CPC ..... B05D 1/00; D21H 25/02; D21H 17/07; D21H 17/04; D21H 25/06; D21H 17/17; D21H 17/14; D21H 17/03; D21H 21/16

See application file for complete search history.

(56) References Cited

U.S. PATENT DOCUMENTS

| | | | | |
|---|---|---|---|---|
| 3,184,484 | A | 5/1965 | Catto et al. | |
| 4,040,900 | A | 8/1977 | Mazzarella et al. | |
| 4,222,820 | A * | 9/1980 | Hiskens | C08C 19/28 106/162.9 |
| 4,529,447 | A | 7/1985 | Okada et al. | |
| 4,657,946 | A | 4/1987 | Rende et al. | |
| 4,711,671 | A | 12/1987 | Mazzarella et al. | |
| 4,728,366 | A | 3/1988 | Mazzarella et al. | |
| 5,104,486 | A | 4/1992 | Sweeney | |
| 5,176,748 | A | 1/1993 | Nikoloff et al. | |
| 6,165,259 | A | 12/2000 | Hällström et al. | |
| 6,273,997 | B1 | 8/2001 | Ehrhardt et al. | |
| 6,485,555 | B1 | 11/2002 | Kindgren et al. | |
| 6,509,417 | B1 | 1/2003 | Wetzel et al. | |
| 6,692,560 | B2 | 2/2004 | Holmberg et al. | |
| 7,455,751 | B2 | 11/2008 | Ward et al. | |
| 2003/0097964 | A1 | 5/2003 | Holmberg et al. | |
| 2006/0060814 | A1 | 3/2006 | Pawlowska et al. | |
| 2009/0320708 | A1 * | 12/2009 | Jackson | B41M 5/0035 101/483 |
| 2012/0107511 | A1 | 5/2012 | Luu et al. | |

FOREIGN PATENT DOCUMENTS

| | | | |
|---|---|---|---|
| CN | 1214093 | A | 4/1999 |
| CN | 1246899 | A | 3/2000 |
| EP | 0217202 | A1 | 4/1987 |
| EP | 2463020 | A2 | 6/2012 |
| JP | 63-112797 | A | 5/1988 |
| WO | WO 97/31152 | A1 | 8/1997 |
| WO | WO 98/33979 | A1 | 8/1998 |
| WO | WO 01/44575 | A1 | 6/2001 |
| WO | WO 2005/118953 | A1 | 12/2005 |
| WO | WO 2012/144233 | A1 | 10/2012 |

OTHER PUBLICATIONS

Merisalo, "Optimization of ASA Emulsification in Internal Sizing of Paper and Board," Master's Thesis, Helsinki University of Technology, 108 pp. (Nov. 13, 2009).

KIPO, International Search Report in International Patent Application No. PCT/US2014/042293, dated Oct. 10, 2014, 4 pp.

KIPO, Written Opinion in International Patent Application No. PCT/US2014/042293, dated Oct. 10, 2014, 6 pp.

U.S. Appl. No. 14/303,851, filed Jun. 13, 2014.

"Chemistry Dictionary 3," Pocket Ed., (14th printing), Kyoritsu Shuppan Co., Ltd., Japan, pp. 606-607 (1972).

* cited by examiner

*Primary Examiner* — Hai Y Zhang

(74) *Attorney, Agent, or Firm* — Eric S. Babych; Barnes & Thornburg LLP

(57) ABSTRACT

Water-free compositions suitable for application as a surface size to a cellulosic substrate, and methods of applying the water-free compositions to the surface of a cellulosic substrate.

13 Claims, No Drawings

WATER-FREE SURFACE SIZING COMPOSITION AND METHOD FOR TREATING A PAPER SUBSTRATE WITH SAME

This application is a divisional of copending U.S. patent application Ser. No. 14/303,851, filed Jun. 13, 2014, which claims the benefit of U.S. Provisional Patent Application No. 61/834,530, filed Jun. 13, 2013, each disclosure of which is herein incorporated by reference in its entirety.

FIELD

The technical field relates to compositions containing sizing agents useful in the paper industry and to a method of treating a paper substrate with such compositions.

BACKGROUND

Cellulose, which is the main component of paper substrates, is hydrophilic and polar. These characteristics result in rapid water penetration in the paper substrate. This phenomenon can be delayed by hydrophobation of the paper substrate. This operation is known as "paper sizing." By this operation, the penetration of polar liquids (e.g., water or inks) in the paper is delayed by recovering the cellulose fibers with a hydrophobic substance, which is called a sizing agent. The sizing agent is usually added to the paper pulp and retained by the cellulose fibers in the wet end part of the paper manufacturing process. This is called internal sizing. However, the sizing agent can also be applied to the surface of the dried or partially dried paper, i.e., surface sizing.

Typical sizing agents include rosin, alkenyl succinic anhydrides ("ASAs") and alkyl ketene dimers ("AKDs"). ASAs are good candidates for surface sizing of paper substrates due to their high reactivity towards the hydroxyl groups of the cellulose. The reaction between ASAs and cellulose can be represented as follows:

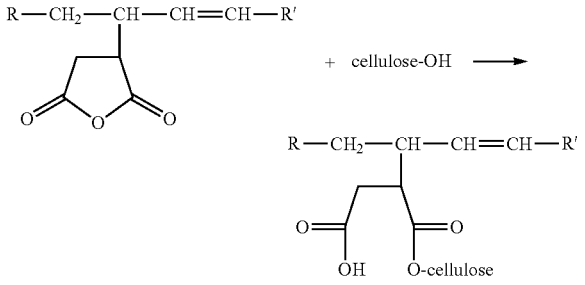

The formation of covalent bonds between the cellulose and the ASA translates into an efficient sizing and the resulting paper products show a good resistance to polar liquids penetration.

For surface sizing applications, the ASA is generally emulsified in water and the emulsion is applied using a sizing press or a coater. ASA emulsion can also, but less often, be applied using a shower. However, some curl problems have been observed when applying ASA water emulsions using showers. Moreover, for efficiency reasons and to obtain a sizing as homogeneous as possible, the particle size has to be controlled and a limited particle size range must be obtained. The water emulsion containing ASA must also be used quickly so as to limit ASA's hydrolysis, which produces a product interfering with sizing.

Methods have been proposed to prevent ASA's hydrolysis. For example, a water emulsion containing cationic starch is prepared as late as possible before application. However, the process for mixing the ASA with cationic starch is rather complicated and uses a complex machine.

Another known hydrophobation method used to increase paper water resistance is vapor depositing the ASA on the paper surface. In this case, ASA in gaseous phase contacts the paper surface and reacts with the hydroxyl groups of the cellulose. However, applying such a method at an industrial scale would imply using a complex system in order to avoid releasing ASA in the atmosphere surrounding the machine. A complicated system would be required for confining the molecules in gaseous phase while allowing their contact with the paper sheet in continuous movement.

In light of the aforementioned, there is thus a need for new ASA containing sizing compositions as an alternative to ASA water based compositions.

SUMMARY

It is therefore an aim of the present invention to address the above mentioned issues.

In one aspect, there is provided a water-free surface sizing composition comprising at least one alkenyl succinic anhydride and at least one biosolvent for adjusting a viscosity of the composition to allow spraying thereof on a paper surface.

In another aspect, there is provided a method for treating a paper substrate with the water-free surface sizing composition, comprising spraying the composition onto the surface of the paper substrate and heating the paper substrate treated with the composition.

In another aspect, there is provided a use of the water-free surface sizing composition for providing water resistance or improving water resistance of a paper substrate.

Other objects, advantages and features of the present invention will become more apparent upon reading of the following non-restrictive description of embodiments thereof.

DETAILED DESCRIPTION

A water-free sizing composition providing water-resistance to the surface of paper substrates will be described.

In the present description, the expression "paper substrate" refers to any type of cellulosic fiber-based substrate including, for example, and without being limited to, any suitable wood-fiber based material, such as recycled or virgin liner, medium, chipboard, paperboard, folding carton, kraftpak paper, bag paper, fine paper and the like.

The cellulose in the cellulosic fiber-based substrate is accessible for surface treatment. In other words, hydroxyl groups of the cellulose included in the paper substrate are accessible for reacting with the ASA molecules of the water-free composition. If the cellulose in the paper substrate has previously been surface treated, for example, with starch, remaining hydroxyl groups have to be accessible for reacting with the ASA of the water-free composition. In one embodiment, the cellulose in the paper substrate to be treated with the water-free sizing composition containing ASA has not been subjected to a previous surface treatment. In another embodiment, the paper substrate may have been subjected to an internal sizing treatment prior to the surface treatment with the water-free composition. The internal sizing treatment may be carried out using any sizing agent known in the art for internal treatment. For example, the internal sizing agent can be an AKD or an ASA. When an ASA is used as internal sizing agent, it can be the same or different than the ASA present in the water-free composition with biosolvent.

Broadly described, the sizing composition is a water-free or substantially water-free solution of at least one ASA in a biosolvent. The composition has a viscosity that allows it to be sprayed on the paper substrate.

By "sprayed" or "spraying", it is meant that the composition is applied as a liquid broken up into minute droplets being blown, ejected into, or falling through the air to then reach the surface of the paper substrate. In an embodiment, the composition is applied to the paper surface in the liquid state either using a shower or by discharge from a pressurized container through spray nozzles.

ASAs are liquid products having a relatively high viscosity. Mixing the ASA with a biosolvent or mixture of biosolvents preferably reduces the viscosity of the ASA in the resulting composition. With an appropriate viscosity, the composition can be applied by spraying on the paper substrate. This results in a substantially homogeneous distribution of the ASA onto the paper surface. The ASA is thus allowed to react with accessible hydroxyl groups of the cellulose in the paper substrate and hydrophobicity of the paper substrate is thus increased.

The ASAs that can be used in the composition include any ASA commonly used as an internal sizing agent in the paper industry. It is also possible to use a mixture of different ASAs in the composition.

In an embodiment, the ASA has an alkenyl group of from 16 to 20 carbon atoms. In another embodiment the ASA has an alkenyl group of from 16 to 18 carbon atoms. When the composition contains a mixture of ASAs wherein each has from 16 to 20 carbon atoms in its alkenyl group. Moreover, the double bond of the alkenyl group can be in any position on the alkenyl chain.

According to another embodiment, the ASA used in the composition include hexadecenyl succinic anhydride, octadecenyl succinic anhydride or any mixture thereof, wherein the double bond of the alkenyl group is in any position on the alkenyl chain.

In another embodiment, the ASA added to the composition is present in the product NALSIZE® 7542, sold by Nalco Company, or HYDRORES™ AS 2300, sold by Kemira Chemicals. NALSIZE 7542 is a mixture of ASAs ($C_{16}$-$C_{18}$) containing up to 2% nonionic surfactant. HYDRORES AS 2300 is ASA having a linear alkenyl chain of 18 carbon atoms.

In the composition, the ASA or mixture of ASAs are combined with at least one biosolvent to decrease the viscosity of the ASA(s). In some embodiments, a mixture of biosolvents can be used to achieve the required viscosity. The mixture ASA(s)-biosolvent(s) is a liquid solution that is substantially homogeneous.

Biosolvents, as opposed to petroleum-derived solvents, are solvents from natural origin which are issued from treated or untreated plant, animal or mineral raw materials.

Examples of biosolvents which can be used in the composition include biodiesels which are vegetable oil- or animal fat-based diesel fuel comprising long-chain alkyl (e.g., methyl, propyl or ethyl) esters.

Other examples of biosolvents include dipentene, the racemic of (+) and (−) limonene. It is also possible to use only one of the enantiomers of limonene.

Other possible biosolvents to be used in the composition include fatty acid esters and fatty acid amides. The fatty acid esters or amides are either saturated or unsaturated. In an embodiment, the fatty acid esters are fatty acid methyl esters and the fatty acid amides are N,N-dimethyl fatty acid amides. In some embodiments, the aliphatic chain of the fatty acid esters has from 8 to 18 carbon atoms. Examples of fatty acid esters include methyl caprylate, methyl laurate, methyl oletate, or methyl palmitate. In some embodiments, the aliphatic chain of the fatty acid amides has 8 or 10 carbon atoms. The fatty acid amides may be N,N-dimethylcapryl-amide or N,N-dimethylcapramide.

As previously mentioned, the use of a biosolvent or a mixture of biosolvents can be utilized to decrease the viscosity of the ASAs, thereby obtaining a sizing composition that is sprayable. In an embodiment, the biosolvent and its relative amount in the composition are determined to achieve a composition with a viscosity of about 100 cPs or less. In another embodiment, the composition has a viscosity of from about 25 to about 100 cPs. In some embodiments, the viscosity of the composition can be between about 25 and about 90 cPs.

The term "about" as used in the present description means within an acceptable error range for the particular value as determined by one of ordinary skill in the art, and will depend in part on how the value is measured or determined, i.e., the limitations of the measurement system. It is commonly accepted that a 10% precision measure is acceptable and encompasses the term "about."

In another embodiment, the sizing composition has a flash point of at least about 50° C. The value of the flash point of the composition will principally depend on the nature and proportions of the biosolvent(s) used in the composition. The proportion of ASAs is also taken into account. ASAs have high flash points and contribute to an increase of the flash point of the composition. A person skilled in the art will be able to choose the appropriate biosolvents and to estimate the proportions thereof to obtain a composition with an appropriate flash point. In some embodiments, the flash point is chosen so as to minimize flammability risks of the composition in the dryer or through the contact with hot surfaces during the sizing process. For example, the flash point of the composition may be of at least about 93° C.

The surface sizing composition is obtained by mixing the ASA or mixture of ASAs with the biosolvent or mixture of biosolvents.

In an embodiment, the ASA or mixture of ASAs are added in about 1 wt % to about 80 wt % of the weight of the composition. In another embodiment, ASA(s) represent(s) about 40 wt % to about 70 wt % of the weight of the composition.

The biosolvent or mixture of biosolvents can be present in about 20 wt % to about 99 wt % of the weight of the composition, or in about 30 wt % to about 60 wt % of the weight of the composition.

In another embodiment, the surface sizing composition comprises about 60% w/w of ASA and about 40% w/w of biosolvent or mixture of biosolvents. The ASA can be NALSIZE 7542 and the biosolvent a mixture of biodiesel and limonene.

Table 1 below provides examples of sizing compositions according to specific embodiments.

TABLE 1

| | Composition 1 | Composition 2 |
|---|---|---|
| NALSIZE 7542 | 60% w/w | 60% w/w |
| Biodiesel | 38% w/w | 35% w/w |
| Limonene | 2% w/w | 5% w/w |

TABLE 1-continued

| | Composition 1 | Composition 2 |
|---|---|---|
| Viscosity 50 rpm, spindle #1 | 43 cp | 41 cp |
| Flash point | 107° C. | 95° C. |

An embodiment of a method for treating a paper substrate with the sizing composition will be now described.

The method generally involves spraying the composition onto the surface of the paper substrate and then heating the treated substrate.

The paper substrate, which can be a recycled or virgin liner, medium, chipboard, folding carton, kraftpak paper, paperboard, bag paper, fine paper or any other cellulosic fiber-based substrate, is provided to the sizing machine where the composition is allowed to be sprayed on its surface using a sprayer.

In an embodiment, the composition is applied to the paper surface in the liquid state using a shower or any spray equipment commonly known in the art. For example, the composition can be applied by discharge from a pressurized container through a multi-nozzles spraying system. Alternatively, the composition can be applied using a rotor damping system, for instance a WEKO-RFT Rotor Damping System.

When the water-free composition is sprayed using a multi-nozzles spraying system, the nozzles can be appropriately placed across the width of the paper machine. The spray nozzles are designed and spaced to ensure even distribution of the composition on the paper sheet.

In an embodiment, the composition is applied at room temperature on the paper surface. The quantity of composition applied to the surface of the paper substrate may depend on the type of substrate and the intended water barrier. In an embodiment, the quantity of composition applied to the surface of the paper substrate is from about 0.2 to about 10 g/m$^2$. In another embodiment, the quantity of composition applied to the surface of the paper substrate is from about 0.2 to about 2 g/m$^2$.

Once the water-free sizing composition has been applied on the surface of the paper, the treated paper is then passed through a dryer or heater to provide the energy required to allow the reaction between the hydroxyl groups of the cellulose included in the paper and the ASA molecules, and the surface of the substrate becomes hydrophobic.

Usually, dryers/heaters commonly used in paper making processes are adapted for heating the paper treated with the water-free composition and there is no need to modify their temperature.

As previously mentioned, the water-free surface sizing composition once applied to the paper and after heating thereof, provides good water resistance properties to the paper. The so treated paper can show Cobb$_2$ values from about 27 $g_{water}$/m$^2$ to about 50 $g_{water}$/m$^2$. The so treated paper can be used in many applications, for example, printing paper, linerboard, for folding box and protective headers.

The present water-free sizing composition and the way it is applied to the paper substrate show various advantages over known paper sizing methods. The use of a water-free sizing composition allows avoiding paper curl problems that can be observed when applying water based sizing compositions using showers.

The present water-free composition, thanks to the biosolvents it contains, is more environmentally friendly than compositions containing petroleum based solvents.

The following examples are provided to illustrate some properties and advantages of the coating.

EXAMPLES

Example 1

Water-free surface sizing compositions have been prepared as summarized in Table 2. Their viscosities and flash points have been determined and are also reported in Table 2.

TABLE 2

| Composition | | B1 | B2 | B3 | T1 | T2 | T3 | T4 | T6 | D3 | D5 | T12 | T13 |
|---|---|---|---|---|---|---|---|---|---|---|---|---|---|
| ASA* | (w/w %) | 1 | 1 | 1 | 60 | 60 | 60 | 60 | 60 | 75 | 90 | 60 | 80 |
| Biodiesel** | (w/w %) | 99 | 0 | 0 | 40 | 35 | 30 | 20 | 0 | 0 | 0 | 38 | 18 |
| Limonene | (w/w %) | 0 | 0 | 99 | 0 | 5 | 10 | 20 | 40 | 25 | 10 | 2 | 2 |
| Dipentene | (w/w %) | 0 | 99 | 0 | 0 | 0 | 0 | 0 | 0 | 0 | 0 | 0 | 0 |
| Viscosity, spindle #1, 22° C. | (cP) | 23 | 11 | 10 | 44 | 41 | 38 | 32 | 24 | 40 | 80 | 43 | 85 |
| Flash point | (° C.) | 120 | 50 | 55 | 180 | 95 | 83 | 67 | 54 | 65 | 78 | 107 | 109 |

*ASA is NALSIZE 7542.

**Biodiesel derived from vegetable oils

Example 2

Compositions B1, B2 and B3 of Table 1 were tested to evaluate their sizing properties.

2.4 g paper handsheets were prepared using brown pulp (100% old corrugated containers ("OCC")). The retention system was composed of 0.6 kg/t PERCOL® 3320 CB ("C-PAM") (polyacrylamide, available from BASF) and 4 kg/t LUREDUR® 8097 (partially hydrolyzed polyvinyl formamide, available from BASF). The paper handsheets dryness before applying the compositions was 34%.

The compositions were applied onto the surface of the 2.4 g paper handsheets using an aerograph. The liquid compositions were uniformly vaporized using compressed air. The handsheets were then dried at 105° C. for 15 minutes and left for 5 days at 23° C. under 50% relative humidity. Cobb$_{2\ min}$ values were then measured. The results are reported in Table 3. Measurements were also performed for an untreated paper handsheet for comparison. The Cobb$_{2\ min}$ for the untreated substrate was above 220 $g_{water}$/m$^2$.

TABLE 3

| Solution | | B1 | B2 | B3 |
|---|---|---|---|---|
| ASA | (%) | 1 | 1 | 1 |
| Biodiesel | (%) | 99 | 0 | 0 |
| Limonene | (%) | 0 | 0 | 99 |

TABLE 3-continued

| Solution | | B1 | B2 | B3 |
|---|---|---|---|---|
| Dipentene | (%) | 0 | 99 | 0 |
| $Cobb_{2\ min}$ | ($g_{water}/m^2$) | 36 | 42 | 27 |

The results presented in Table 3 show that the paper substrate was successfully treated with compositions B1-B3. The paper substrate treated with any one of compositions B1-B3 has an improved water resistance compared to the untreated substrate, even with a very low content of the ASA in the composition.

Example 3

A composition was prepared by mixing 60% (w/w) NALSIZE 7542 as ASA, and a mixture of 35% (w/w) biodiesel and 5% (w/w) limonene as biosolvent. The composition was applied to the surface of a cardboard (recycled paper; basis weight 679 $g/m^2$), at the mill before the dyer section, using a spray gun. The sizing efficacy was studied over time by measuring Cobb values four times within a period of one year and 4 months. The treated cardboard was not oven-dried. The untreated surface allowed water penetration into the cardboard on the $Cobb_{2\ min}$ test (about 967 $g_{water}/m^2$).

The results of the Cobb tests are provided in Table 4.

TABLE 4

| Time after treatment | $Cobb_{2\ min}$ ($g_{water}/m^2$) | $Cobb_{15\ min}$ ($g_{water}/m^2$) | $Cobb_{30\ min}$ ($g_{water}/m^2$) |
|---|---|---|---|
| 0 * | 31 | 70 | n.d. |
| 2 weeks | 32 | 71 | n.d. |
| 4 weeks | 30 | 70 | n.d. |
| 1 year and 4 months | n.d. | 70 | 102 |

* measurements were performed on the cardboard immediately after treatment
n.d.: not determined The values of $Cobb_{2\ min}$ (about 30 $g_{water}/m^2$) and $Cobb_{15\ min}$ (about 70 $g_{water}/m^2$) show that the application of the ASA in biosolvents increases the hydrophobicity of the cardboard surface compared to the untreated cardboard ($Cobb_{2\ min}$ of about 967 $g_{water}/m^2$).

The above-described embodiments and examples are considered in all respect only as illustrative and not restrictive, and the present application is intended to cover any adaptations or variations thereof, as apparent to a person skilled in the art. Of course, numerous other modifications could be made to the above-described embodiments without departing from the scope of the invention, as apparent to a person skilled in the art.

The scope of the invention is therefore intended to be limited solely by the scope of the appended claims.

We claim:

1. A method of treating a paper substrate having a surface, the method comprising:

spraying a surface sizing composition comprising an alkenyl succinic anhydride and a biosolvent onto the surface of the paper substrate, thereby forming a treated substrate;

wherein the biosolvent comprises at least one of biodiesel, dipentene, limonene, and the surface sizing composition has a viscosity of from 25 cPs to 90 cPs.

2. The method of claim 1, wherein the alkenyl succinic anhydride comprises an alkenyl succinic anhydride having an alkenyl group of from 16 to 20 carbon atoms.

3. The method of claim 1, wherein the alkenyl succinic anhydride comprises an alkenyl succinic anhydride selected from hexadecenyl succinic anhydride, octadecenyl succinic anhydride, and combinations thereof.

4. The method of claim 1, wherein the alkenyl succinic anhydride is present in the surface sizing composition at a concentration of from 1 wt % to 80 wt %.

5. The method of claim 1, wherein the biosolvent is present in the composition at a concentration of from 20 wt % to 99 wt %.

6. The method of claim 1, wherein the alkenyl succinic anhydride comprises an alkenyl succinic anhydride having an alkenyl group of from 16 to 20 carbon atoms and is present in the surface sizing composition at a concentration of from 1 wt % to 80 wt %, wherein the biosolvents present in the surface sizing composition at a concentration of from 20 wt % to 99 wt %.

7. The method of claim 1, wherein the alkenyl succinic anhydride comprises an alkenyl succinic anhydride having an alkenyl group of from 16 to 20 carbon atoms and is present in the surface sizing composition at a concentration of from 40 wt % to 70 wt %, wherein the biosolvent comprises at least one of biodiesel, limonene and dipentene and is present in the surface sizing composition at a concentration of from 20 wt % to 99 wt %.

8. The method of claim 1, wherein the paper substrate comprises recycled liner, virgin liner, partially recycled liner, medium paper, fine paper, chipboard, folding carton, kraftpak paper, paperboard, or bag paper.

9. The method of claim 1, wherein the paper substrate was subjected to an internal sizing treatment prior to the spraying.

10. The method of claim 9, wherein the internal sizing treatment comprises applying at least one of an alkyl ketene dimer and an alkenyl succinic anhydride.

11. The method of claim 1, wherein the surface sizing composition is sprayed at from 0.2 gram to 10 grams per square meter of surface of the paper substrate.

12. The method of claim 1, wherein the surface sizing composition is a water-free surface sizing composition.

13. The method of claim 1, further comprising heating the treated substrate.

* * * * *